US009597566B2

(12) United States Patent
Ishihara et al.

(10) Patent No.: US 9,597,566 B2
(45) Date of Patent: Mar. 21, 2017

(54) GOLF CLUB

(71) Applicant: BRIDGESTONE SPORTS CO., LTD, Tokyo (JP)

(72) Inventors: Tomotaka Ishihara, Chichibu (JP); Wataru Ban, Chichibu (JP); Fumiaki Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 31 days.

(21) Appl. No.: 14/527,133

(22) Filed: Oct. 29, 2014

(65) Prior Publication Data

US 2015/0119162 A1 Apr. 30, 2015

(30) Foreign Application Priority Data

Oct. 30, 2013 (JP) ..... 2013-225482

(51) Int. Cl.

*A63B 53/08* (2015.01)
*A63B 59/00* (2015.01)
*A63B 53/10* (2015.01)
*A63B 53/02* (2015.01)

(52) U.S. Cl.

CPC ..... *A63B 59/0092* (2013.01); *A63B 53/10* (2013.01); *A63B 60/06* (2015.10); *A63B 60/08* (2015.10); *A63B 60/10* (2015.10); *A63B 60/54* (2015.10); *A63B 53/02* (2013.01)

(58) Field of Classification Search

CPC . A63B 59/0092; A63B 53/10; A63B 59/0014; A63B 60/08; A63B 60/10; A63B 60/06; A63B 60/54; A63B 53/02

See application file for complete search history.

(56) References Cited

U.S. PATENT DOCUMENTS 3,984,103 A * 10/1976 Nix ..... A63B 53/00 473/291
5,294,119 A * 3/1994 Vincent ..... A63B 53/10 273/DIG. 23
5,322,290 A * 6/1994 Minami ..... A63B 53/14 473/201
RE34,767 E * 10/1994 Soong ..... A63B 53/14 473/300

(Continued)

FOREIGN PATENT DOCUMENTS

JP 2008-212344 A 9/2008
JP 2011-56118 A 3/2011
JP 2011-229562 A 11/2011

*Primary Examiner* — Stephen Blau

(74) *Attorney, Agent, or Firm* — Surhrue Mion, PLLC

(57) ABSTRACT

A golf club includes a shaft; a head mounted to the tip end of the shaft; a grip mounted to the butt end of the shaft; a first vibration damping member arranged on the head side of the shaft; and a second vibration damping member arranged on the grip side of the shaft. The first range of the shaft in which the first vibration damping member is arranged includes a position of the shaft corresponding to the top end of the hosel of the head and has a length of 25 to 250 mm in the longitudinal direction of the shaft. The second range of the shaft in which the second vibration damping member is arranged includes a position of the shaft corresponding to the tip end of the grip and has a length of 150 to 250 mm in the longitudinal direction of the shaft.

11 Claims, 5 Drawing Sheets

(56) References Cited

U.S. PATENT DOCUMENTS

| | | | | | |
|---|---|---|---|---|---|
| 6,022,278 | A * | 2/2000 | Vela | A63B 53/14 | 473/201 |
| 6,042,485 | A * | 3/2000 | Cheng | A63B 60/10 | 473/318 |
| 6,984,179 | B2 * | 1/2006 | Braly | A63B 53/12 | 473/289 |
| 8,858,356 | B2 * | 10/2014 | Chu | A63B 53/14 | 473/300 |
| 2007/0026960 | A1 * | 2/2007 | Butler | A63B 53/10 | 473/316 |
| 2011/0319187 | A1 * | 12/2011 | Chou | A63B 53/02 | 473/310 |
| 2013/0029781 | A1 * | 1/2013 | Beno | A63B 53/10 | 473/345 |

* cited by examiner

GOLF CLUB

CROSS-REFERENCE TO RELATED APPLICATION

This Application claims priority from Japanese Patent Application No. 2013-225482 filed Oct. 30, 2013, which is incorporated herein by reference in its entirety.

BACKGROUND OF THE INVENTION

The present invention relates to a golf club, and more particularly relates to a golf club produced by using a material having a vibration damping performance.

When a golfer hits a ball with a golf club, vibration is caused in the shaft, which is transmitted to the body of the golfer. Golfers generally feel annoyed when large vibration remains in the shaft. Accordingly, shafts for golf clubs that damp such vibration have been developed. For example, Japanese Patent Application Publication No. 2011-056118 discusses a technique in which damping member sheet layers which are 110 to 150 mm long in the longitudinal direction are arranged between bias layers of a shaft in a range of 55 to 80% of the length of the shaft from its tip end. Japanese Patent Application Publication No. 2008-212344 discusses a technique in which a shaft is provided with a coating layer including a vibration damping coating layer containing vibration damping metal powders.

Japanese Patent Application Publication No. 2011-229562 discusses a technique in which in order to change the location of a portion of a shaft which is easy to bend, an attachment having a half-split cylindrical shape is arranged on an outer periphery side of a shaft in a hosel portion in which the shaft is attached to the head.

SUMMARY OF THE INVENTION

The techniques disclosed in the above-described publications have a problem in that vibration in a golf club cannot be sufficiently damped.

An object of the present invention is to provide a golf club capable of greatly damping vibration in a golf club that may occur when a golfer hits a ball with the golf club.

In order to solve the above-described problem, according to an aspect of the present invention, a golf club includes a shaft having a tip end and a butt end; a head mounted to the shaft on the tip end thereof, the head comprising a hosel having a hosel top end; a grip mounted to the shaft on the butt end thereof, the grip having a tip end and a butt end; a first vibration damping member arranged on a head side of the shaft along a longitudinal direction of the shaft; and a second vibration damping member arranged on a grip side of the shaft along the longitudinal direction of the shaft. A first range of the shaft in which the first vibration damping member is arranged includes a position of the shaft corresponding to the top end of the hosel of the head and has a length of 25 to 250 mm in the longitudinal direction of the shaft. A second range of the shaft in which the second vibration damping member is arranged includes a position of the shaft corresponding to the tip end of the grip and has a length of 150 to 250 mm in the longitudinal direction of the shaft.

The first vibration damping member may be arranged between the shaft and the head, and the second vibration damping member may be arranged between the shaft and the grip. The shaft has a cylindrical shape, and each of the first and second vibration damping members may be arranged on an inner side of the cylindrical shape of the shaft.

Each of the first and second vibration damping members may have a multilayered structure including at least two layers of a core layer and a damping layer. The damping layer may have a thickness of 0.02 to 0.2 mm.

DESCRIPTION OF THE EMBODIMENTS

Figure 1:
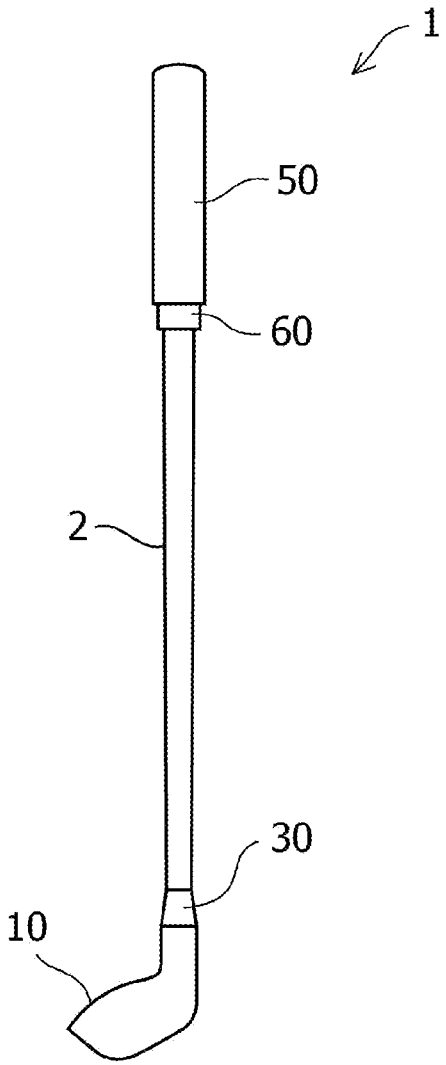
FIG. 1 is a schematic view showing an embodiment of a golf club according to the present invention.

Hereinafter, embodiments of a golf club according to the present invention will now be described in detail with reference to the accompanying drawings. As shown in FIG. 1, a golf club 1 includes a golf club shaft 2, a head 10 attached on a tip end (i.e., head side) of the shaft 2, and a grip 50 attached on a butt end (i.e., grip side) of the shaft 2. The shaft 2 has such a cylindrical shape that the diameter thereof decreases from the butt end toward the tip end.

The length of the shaft 2 may be an ordinary length of shafts for wood clubs, and specifically, the shaft 2 preferably has a length of 42.5 to 47.0 inches (1,080 to 1,194 mm). The diameter of the shaft 2 may also be an ordinary diameter of shafts for wood clubs. Specifically, the shaft 2 preferably has an outer diameter of 14.0 to 16.0 mm on the butt side and an outer diameter of 8.5 to 9.5 mm on the tip side. The weight of the shaft 2 may preferably be in a range of 40 to 65 g for shafts for wood clubs.

Figure 2:
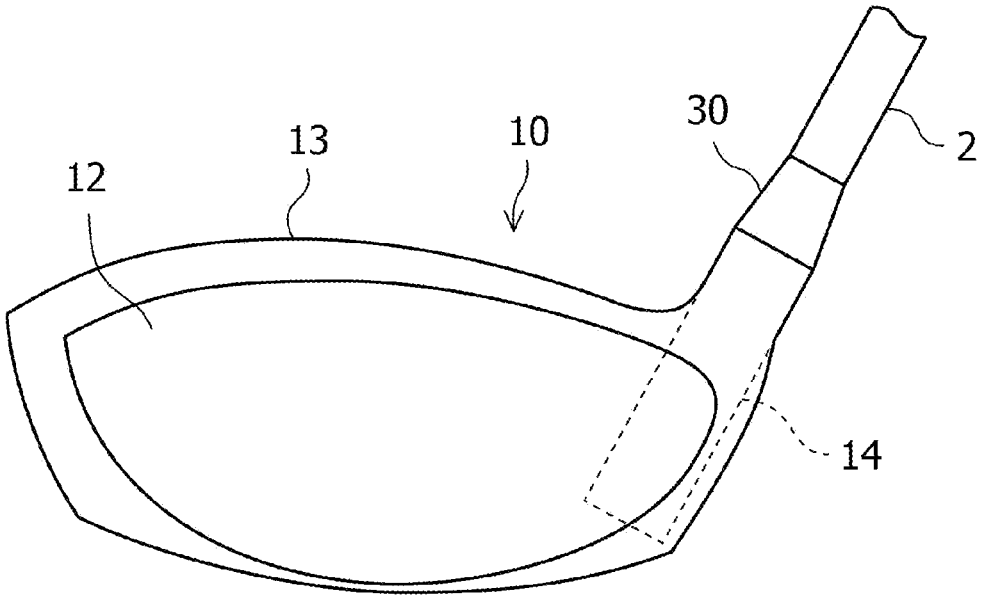
FIG. 2 is a schematic view showing a head and the connecting portion of the golf club illustrated in FIG. 1.
Figure 3:
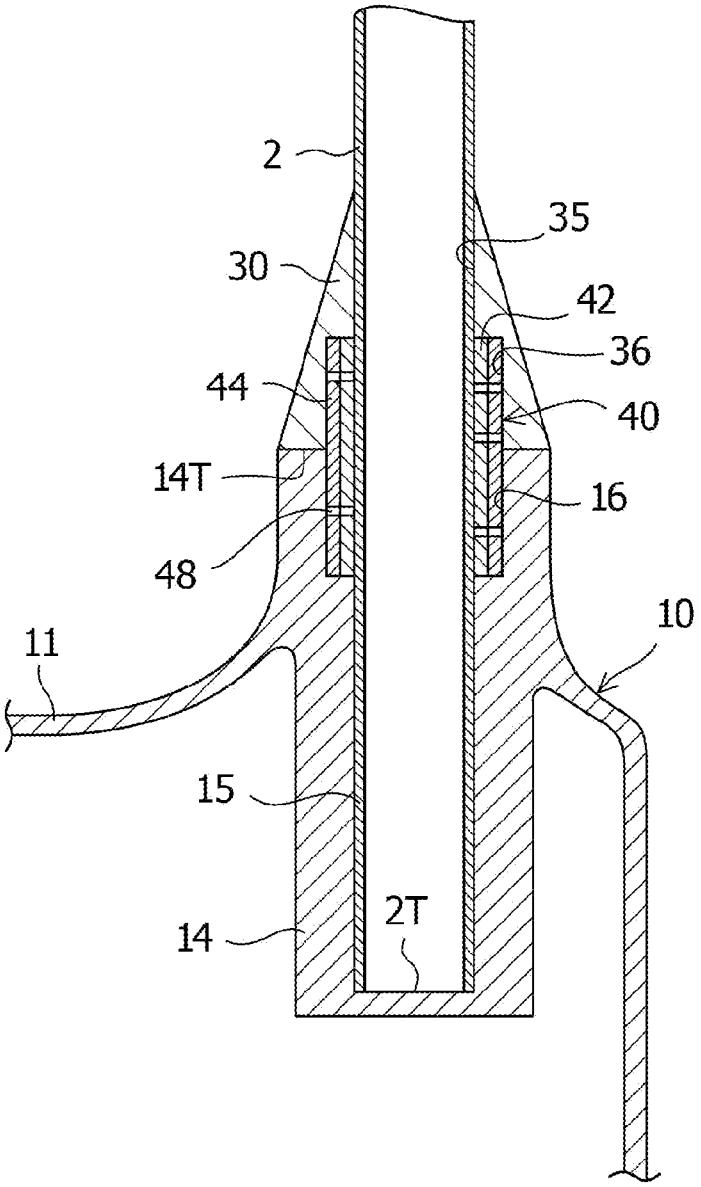
FIG. 3 is a cross-sectional view of a hosel and the surroundings of the golf club illustrated in FIG. 1.
Figure 4:
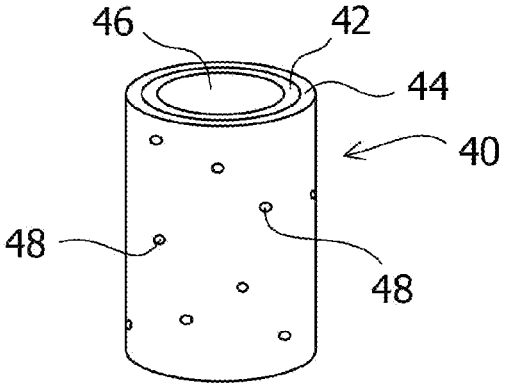
FIG. 4 is a perspective view showing a first damping member arranged between the shaft and the head illustrated in FIG. 3.

As shown in FIGS. 2 to 4, the head 10 has a hollow structure surrounded by an outer shell 11 made of a metal material such as titanium. The head 10 includes a face portion 12 having a golf ball hitting surface, a crown portion 13 which is an upper surface of the head, and a hosel 14 into which the shaft 2 is attached. The hosel 14 includes a shaft insertion hole 15 extending from a hosel top end 14T, which is located further above the crown portion 13, toward an inside of the hollow structure of the head 10. The shaft 2 is inserted into the shaft insertion hole 15 from the tip end of the shaft 2 and is bonded to the head 10 in the hosel 14 by using an adhesive or the like.

A ferrule 30 is attached to the shaft 2 on a part of an outer periphery thereof, and extends further upward from the top end 14T of the hosel 14. In other words, the ferrule 30 has a shaft insertion hole 35, in which the shaft 2 is inserted and fixed. The ferrule 30 has a cylindrical shape of which the diameter becomes smaller from the hosel 14 toward the shaft 2 in order to improve the appearance of the portion for connection between the shaft 2 and the hosel 14. The ferrule 30 is made of a synthetic resin such as a cellulose-based material.

Between the shaft 2 and the hosel 14 and between the shaft 2 and the ferrule 30, there is arranged a first vibration damping member 40. The first vibration damping member 40 has a cylindrical shape surrounding a shaft insertion hole 46 and has a multilayered structure including at least two layers of an inner core layer 42 and an outer damping layer 44.

The first vibration damping member 40 is provided to damp the vibration in the golf club 1 and can absorb vibration energy which occurs upon hitting of a ball with the golf club 1. The damping layer 44 of the first vibration damping member 40 is formed by a gel material, such as a silicone gel material or a urethane gel material. The core layer 42 of the first vibration damping member 40 imparts rigidity to the first vibration damping member 40, and is formed by a polyester-based plastic, an epoxy-based plastic, or a fiberglass reinforced plastic including reinforcing fibers such as carbon fibers synthesized with such polyester-based and epoxy-based plastics.

The hosel 14 of the head 10 has a damping member holding recess 16 on an interior wall of the shaft insertion hole 15 to hold the first vibration damping member 40 therein. The damping member holding recess 16 has a diameter on the hosel top end 14T that is greater than the diameter of the shaft insertion hole 15. Similarly, the ferrule 30 has a damping member holding recess 36 on an interior wall of the shaft insertion hole 35 to hold the first vibration damping member 40 therein. The damping member holding recess 36 has a diameter on the hosel side end of the ferrule is greater than the diameter of the shaft insertion hole 35. The diameters of the damping member holding recess 16 of the hosel 14 and the damping member holding recess 36 of the ferrule 30 are greater than the diameters of the shaft insertion holes 15, 35 corresponding thereto by the dimension equivalent to the thickness of the first vibration damping member 40.

The damping layer 44 of the first vibration damping member 40 preferably has a thickness of 0.02 to 0.2 mm. If the thickness of the damping layer 44 is less than 0.02 mm, the vibration damping effect may not be sufficiently exerted. In addition, if the thickness of the outer damping layer 44 is greater than 0.2 mm, the strength of the lock between the shaft 2 and the hosel 14 may decrease. With respect to a more preferable thickness of the first vibration damping member 40, the lower limit is 0.05 mm and the upper limit is 0.1 mm. The thickness of the core layer 42 is preferably 0.02 to 0.1 mm and more preferably 0.05 to 0.07 mm.

The first vibration damping member 40 has a length of 25 to 250 mm along the longitudinal direction of the shaft 2. If the length of the first vibration damping member 40 is less than 25 mm, the range in which vibration can be absorbed becomes small, and the sufficient effect of damping the vibration in the golf club 1 may not be achieved. In addition, if the length of the first vibration damping member 40 is longer than 250 mm, the strength of the lock between the shaft 2 and the hosel 14 may decrease, and the possible carry may become shorter when no specific improvement of the vibration damping effect is achieved. More preferably, the length of the first vibration damping member 40 may range from 25 to 35 mm, for example, in consideration of a portion of the first vibration damping member 40 to be covered up with the ferrule 30 or the like for improvement of the outer appearance, and the length of the first vibration damping member 40 may range from 150 to 250 mm, considering good exertion of the vibration damping effect. The total of the lengths of the damping member holding recess 16 of the hosel 14 and the shaft insertion hole 35 of the ferrule 30 along the longitudinal direction is the same as the length of the first vibration damping member 40. Note that it is preferable that the length of the damping member holding recess 16 of the hosel 14 be set the same as that of the damping member holding recess 36 of the ferrule 30. To paraphrase this, it is preferable that the hosel top end 14T of the head 10 be located in the middle of the total length of the damping member holding recess 16 of the hosel 14 and the damping member holding recess 36 of the ferrule 30.

The first vibration damping member 40 has a plurality of air holes 48 distributed over the entire member, which passes through the core layer 42 and the damping layer 44, so that the shaft 2 can be easily inserted into the shaft insertion hole 46.

Figure 5:
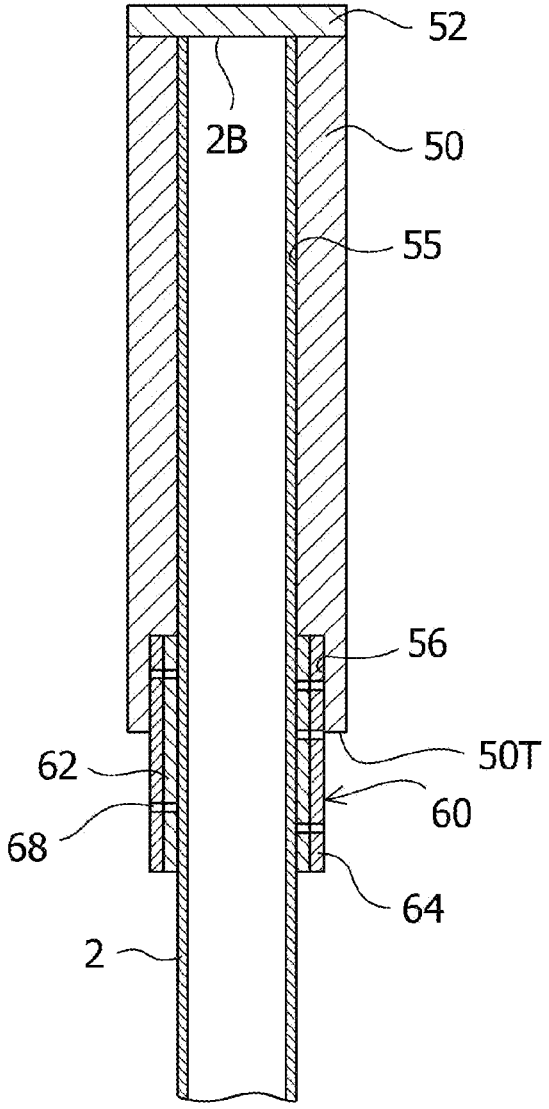
FIG. 5 is a cross-sectional view showing a grip and the connecting portion of the golf club illustrated in FIG. 1.
Figure 6:
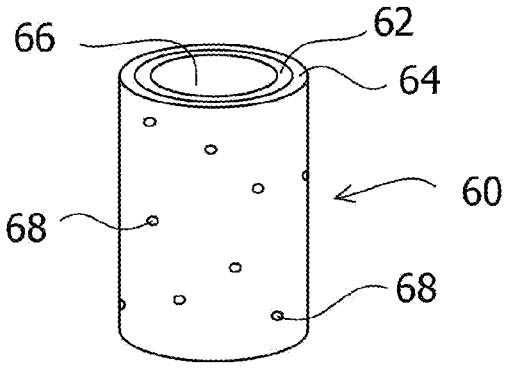
FIG. 6 is a perspective view showing a second damping member arranged between the shaft and the grip illustrated in FIG. 5.

As shown in FIGS. 5 and 6, the grip 50 is provided with a shaft insertion hole 55 extending along the longitudinal direction of the grip. Also, the grip 50 includes a grip end part 52 arranged on a butt end of the grip 50. The shaft 2 on the butt end is inserted in the shaft insertion hole 55 of the grip 50 and is bonded to the grip 50 by using an adhesive or the like. The grip 50 is formed by rubber, a thermoplastic elastomer, or the like.

A second vibration damping member 60 is arranged between the shaft 2 and the grip 50. Similarly to the first vibration damping member 40, the second vibration damping member 60 has a cylindrical shape surrounding a shaft insertion hole 66 and has a multilayered structure including at least two layers of an inner core layer 62 and an outer damping layer 64.

Similarly to the first vibration damping member 40, the second vibration damping member 60 is provided to damp the vibration in the golf club 1 and can absorb vibration energy which occurs upon hitting of a ball with the golf club 1. The damping layer 64 of the second vibration damping member 60 is formed by a gel material, such as a silicone gel material or a urethane gel material. The core layer 62 of the second vibration damping member 60 imparts rigidity to the second vibration damping member 60, and is formed by a polyester-based plastic, an epoxy-based plastic, or a fiberglass reinforced plastic including reinforcing fibers such as carbon fibers synthesized with such polyester-based and epoxy-based plastics.

The grip 50 has a damping member holding recess 56 on an interior wall of the shaft insertion hole 55 to hold the second vibration damping member 60 therein. The damping member holding recess 56 has a diameter on a tip end 50T of the grip is greater than the diameter of the shaft insertion hole 55. The diameter of the damping member holding recess 56 of the grip 50 is greater than the diameter of the shaft insertion hole 55 by the dimension equivalent to the thickness of the second vibration damping member 60.

The thickness of the damping layer 64 of the second vibration damping member 60 is preferably 0.02 to 0.2 mm. If the thickness of the damping layer 64 is less than 0.02 mm, the vibration damping effect may not be sufficiently exerted. In contrast, if the thickness of the outer damping layer 44 is greater than 0.2 mm, the strength of the lock between the shaft 2 and the grip 50 may decrease. With respect to a more preferable thickness of the second vibration damping member 60, the lower limit is 0.05 mm and the upper limit is 0.1 mm. The thickness of the core layer 62 is preferably 0.02 to 0.1 mm and more preferably 0.05 to 0.07 mm.

The second vibration damping member 60 is 150 to 250 mm long along the longitudinal direction of the shaft 2. If the length of the second vibration damping member 60 is less than 150 mm, the range in which vibration can be absorbed becomes small, and the sufficient effect of damping the vibration in the golf club 1 may not be achieved. In contrast, if the length of the second vibration damping member 60 is longer than 250 mm, the strength of the lock between the shaft 2 and the grip 50 may decrease and the possible carry may become shorter when no specific improvement of the vibration damping effect is achieved. A more preferable range of the length of the second vibration damping member 60 is 150 to 200 mm. The length of the damping member holding recess 56 of the grip 50 is shorter than the length of the second vibration damping member 60. Specifically, the second vibration damping member 60 is located across the tip end 50T of the grip 50. The length of the damping member holding recess 56 of the grip 50 is preferably at least 20%, more preferably at least 50%, and still more preferably at least 80% of the length of the second vibration damping member 60.

The second vibration damping member 60 has a plurality of air holes 68 distributed over the entire member, which passes through the core layer 62 and the damping layer 64, so that the shaft 2 can be easily inserted into the shaft insertion hole 66.

As described above, the vibration damping members 40, 60 are arranged in two different locations in the longitudinal direction of the golf club 1. With the above-described configuration, the vibration that may occur in the golf club 1 upon hitting of a ball with the golf club 1 can be remarkably damped. In particular, the first vibration damping member 40 is arranged across the hosel top end 14T because the hosel top end 14T of the shaft 2 is a location where a great force of impact of hitting a ball is applied to the shaft 2. In addition, the second vibration damping member 60 arranged across the grip tip end 50T can effectively absorb the vibration, although the level of exertion of this effect may slightly vary according to the location of gripping by a golfer on the grip 50. Accordingly, the vibration that may occur in the golf club 1 can be effectively damped.

In embodiments illustrated in FIGS. 3 to 6, the first and second vibration damping members 40, 60 are arranged on the outer periphery side of the shaft 2. However, the present invention is not limited to this arrangement. For example, the first and second vibration damping members may be arranged on the inner periphery side of the cylindrically shaped shaft 2. In this case, the damping layer of the vibration damping member is arranged on the center side of the cylindrical shape and the core layer is arranged on the outer side thereof.

The shaft 2 is preferably made of a fiber-reinforced plastic (FRP) material, but is not limited to this. Exemplary materials for the reinforced fiber of the FRP may include carbon fiber, composite fiber including carbon fiber and other fiber materials, metal fiber, and the like. Exemplary materials for the matrix plastic for the FRP may include thermosetting plastic such as epoxy-based resin.

Examples

A golf club including a head and a grip attached to a shaft via vibration damping members was produced ("Example" in the following table), and vibrations on this golf club were determined by a modal analysis. For the shaft, a product with a product name PZ-503W from Bridgestone Sports Corporation made of a carbon fiber reinforced plastic was used. For the head, a product with a product name X-DRIVE 707 from Bridgestone Sports Corporation made of titanium was used. For the grip, a grip made of a rubber material was used. The first vibration damping member arranged between the shaft and the head was constituted by a 0.07 mm-thick core layer formed by a carbon fiber reinforced plastic and a 0.07 mm-thick damping layer formed by a urethane gel material. The first vibration damping member was 30 mm in length and was arranged so that the center of the damping member in the longitudinal direction is located at a location corresponding to the top end of the hosel of the head. The second vibration damping member arranged between the shaft and the grip was constituted by a 0.07 mm-thick core layer formed by a carbon fiber reinforced plastic and a 0.07 mm-thick damping layer formed by a urethane gel material. The second vibration damping member was 150 mm in length and was arranged so that 80% of the damping member is located inside the grip.

Figure 7:
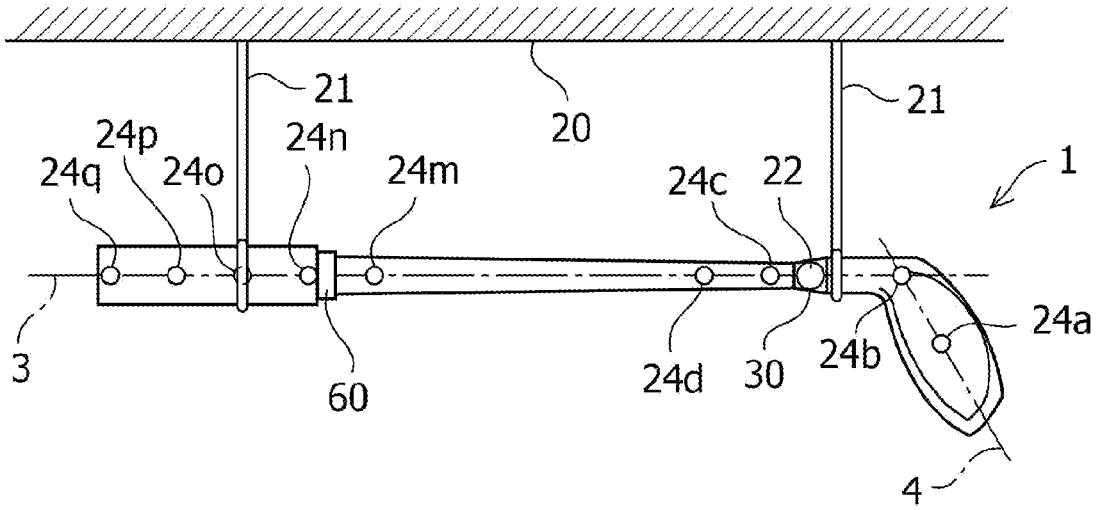
FIG. 7 is a schematic view for explaining how to measure the vibration behavior of the golf club according to the present invention.

As shown in FIG. 7, for the modal analysis on the vibration in the golf club, the golf club 1 was fixed with a rubber band 21 at respective two locations thereof on the top end of the hosel and the grip. Further, the golf club 1 was allowed to hang from a ceiling 20, and also an accelerometer 22 was installed at a location above the top end of the hosel of the club. The golf club was subjected to impacts at excitation points 24 thereof, and the vibration acceleration was measured by using the accelerometer 22. The excitation points 24 were set at a club face center 24*a*, an intersection 24*b* of a shaft axis 3 and a line 4 parallel to the ground plane passing through the face center, and 15 points 24*c* to 24*q*, which were arranged at equal intervals in a range from the top end of the hosel, i.e., one point of fixation of the golf club with the band, to a location distant from the top end of the hosel by 1,100 mm toward the direction of the grip. Damping ratios in the first order to the fourth order vibration modes of the golf club were determined according to the results of the measurement of the vibration acceleration at the respective excitation points. For comparison, the similar modal analysis on vibrations was carried out for a golf club produced without using any vibration damping members ("Comparative example" in the table). Table 1 shows the results of Example and Comparative example.

TABLE 1

| Damping ratio | First order | Second order | Third order | Fourth order |
|---|---|---|---|---|
| Comparative example | 1.428 | 0.649 | 0.449 | 0.281 |
| Example | 1.612 | 0.651 | 0.509 | 0.331 |

As shown in Table 1, in the Example, which used the vibration damping members, the damping ratio was greater than in the Comparative example, which did not use any vibration damping members at all, in the first to the fourth order vibration modes. In particular, in the Example, the damping ratio was significantly greater than the Comparative example in the first, third, and fourth order vibration modes. Thus, the remarkable vibration damping effect was observed.

What is claimed is:

1. A golf club comprising:

a shaft having a tip end and a butt end;

a head mounted to the shaft on the tip end thereof, the head comprising a hosel having a hosel top end;

a grip mounted to the shaft on the butt end thereof, the grip having a tip end and a butt end;

a first vibration damping member arranged on a head side of the shaft along a longitudinal direction of the shaft, wherein a first range of the shaft in which the first vibration damping member is arranged includes a position of the shaft corresponding to the top end of the hosel of the head and has a length of 25 to 250 mm in the longitudinal direction of the shaft; and a second vibration damping member arranged on a grip side of the shaft along the longitudinal direction of the shaft, wherein a second range of the shaft in which the second vibration damping member is arranged includes a position of the shaft corresponding to the tip end of the grip and has a length of 150 to 250 mm in the longitudinal direction of the shaft, wherein the grip has a shaft insertion hole extending along the longitudinal direction of the grip and has a damping member holding recess on an interior wall of the shaft insertion hole to hold the second vibration damping member therein, the second vibration damping member being arranged between the shaft and the grip, wherein each of the first and second vibration damping members has a multilayered structure comprising at least two layers of a core layer and a damping layer.

2. The golf club according to claim 1, wherein the first vibration damping member is arranged between the shaft and the head.

3. The golf club according to claim 1, wherein the shaft has a cylindrical shape, and wherein each of the first and second vibration damping members is arranged on an inner side of the cylindrical shape of the shaft.

4. The golf club according to claim 1, wherein the damping layer has a thickness of 0.02 to 0.2 mm.

5. The golf club according to claim 1, wherein the first vibration damping member has a plurality of air holes, which passes through the core layer and the damping layer.

6. The golf club according to claim 1, wherein the second vibration damping member has a plurality of air holes, which passes through the core layer and the damping layer.

7. The golf club according to claim 1, wherein the damping layer of the first vibration damping member comprises a gel material, and the core layer of the first vibration damping member comprises plastic or carbon fibers.

8. The golf club according to claim 1, wherein the damping layer of the second vibration damping member comprises a gel material, and the core layer of the second vibration damping member comprises plastic or carbon fibers.

9. The golf club according to claim 1, wherein a ferrule is attached to the shaft on a part of an outer periphery thereof and extends further upward from the top end of the hosel of the head.

10. The golf club according to claim 9, wherein the hosel of the head has shaft insertion hole and a damping member holding recess on an interior wall of the shaft insertion hole to hold a part of the first vibration damping member therein, and the ferrule has shaft insertion hole and a damping member holding recess on an interior wall of the shaft insertion hole to hold another part of the first vibration damping member therein.

11. A golf club comprising:

a shaft having a tip end and a butt end;

a head mounted to the shaft on the tip end thereof, the head comprising a hosel having a hosel top end;

a grip mounted to the shaft on the butt end thereof, the grip having a tip end and a butt end;

a first vibration damping member arranged on a head side of the shaft along a longitudinal direction of the shaft, wherein a first range of the shaft in which the first vibration damping member is arranged includes a position of the shaft corresponding to the top end of the hosel of the head and has a length of 25 to 250 mm in the longitudinal direction of the shaft; and a second vibration damping member arranged on a grip side of the shaft along the longitudinal direction of the shaft, wherein a second range of the shaft in which the second vibration damping member is arranged includes a position of the shaft corresponding to the tip end of the grip and has a length of 150 to 250 mm in the longitudinal direction of the shaft, wherein the grip has a shaft insertion hole extending along the longitudinal direction of the grip and has a damping member holding recess on an interior wall of the shaft insertion hole to hold the second vibration damping member therein, the second vibration damping member being arranged between the shaft and the grip, and wherein a length of the damping member holding recess of the grip being shorter than a length of the second vibration damping member.

* * * * *